US005421107A

United States Patent [19]

Bryan

[11] Patent Number: 5,421,107

[45] Date of Patent: Jun. 6, 1995

[54] SELECTIVE NOISEMAKER FOR CHILDREN'S SHOES

[76] Inventor: William N. Bryan, 1013 Cambridge, Allen, Tex. 75002

[21] Appl. No.: 165,987

[22] Filed: Dec. 13, 1993

[51] Int. Cl.[6] ..... A43B 3/30

[52] U.S. Cl. ..... 36/139; 36/112

[58] Field of Search ..... 36/139, 112, 136, 29, 36/35 B, 153, 1

[56] References Cited

U.S. PATENT DOCUMENTS

| | | | |
|---|---|---|---|
| 2,365,807 | 12/1944 | Dialynas | 36/153 |
| 2,532,742 | 12/1950 | Stoiner | 36/35 |
| 2,721,420 | 10/1955 | Chatten | 46/175 |
| 3,340,846 | 9/1967 | Magiera | 116/67 |
| 3,878,641 | 4/1975 | Noble | 46/175 |
| 4,012,854 | 3/1977 | Berend et al. | 36/29 |
| 4,253,254 | 3/1981 | Gill | 36/139 |
| 4,787,100 | 11/1988 | Jonat | 2/80 |
| 5,036,604 | 8/1991 | Rosen | 36/139 |
| 5,224,278 | 7/1993 | Jeon | 36/29 |

FOREIGN PATENT DOCUMENTS

| | | | |
|---|---|---|---|
| 625731 | 12/1926 | France . | |
| 53460 | 4/1912 | Switzerland | 36/139 |
| 2191383 | 12/1987 | United Kingdom . | |
| 2195522 | 4/1988 | United Kingdom | 36/139 |

*Primary Examiner*—Steven N. Meyers
*Assistant Examiner*—Thomas P. Hilliard
*Attorney, Agent, or Firm*—John F. Bryan

[57] ABSTRACT

A child's shoe of elastomeric, deformable sole construction has a cavity located in a middle portion of the sole, between the upper and lower surfaces and connected to the side of the sole by a passageway. In use, volumetric changes of the cavity create an air flow through the passageway and a whistle, with the whistle selectively positioned to make noise or not make noise.

6 Claims, 2 Drawing Sheets

SELECTIVE NOISEMAKER FOR CHILDREN'S SHOES

FIELD OF THE INVENTION

The present invention relates to the field of children's shoes and more particularly to such shoes made in the elastomer and fabric sports style and having a resilient sole which deforms to operate a noisemaking device.

BACKGROUND AND SUMMARY OF THE INVENTION

Shoes of elastomer and fabric construction, originally intended for jogging, basketball and other sports activities, have become the footwear of choice for the youth of today. Needless to say, the youngest are no exception and frequently we find the three year olds shod, "just like big brother and sister."

Shoes outfitted with compression actuated noisemakers have been addressed to the footwear market, notably by Gill, U.S. Pat. No. 4,253,254; Jonat, U.S. Pat. No. 4,787,100; and Griffiths, UK patent no. 2191383. The offerings were made as novelty items for amusing the child, with practical benefits of encouraging toddlers to walk and keeping contact with small children while walking about or shopping. While the concept has merit in each of these areas, adults do not have a desire, or even tolerance, for incessant noise. Moreover, a deformable cavity at either the toe portion of the sole as taught by Jonat, or at the heel portion as taught by Gill and Griffiths will tend to impair support and comfort. Since the toe and heel areas of the sole wear most quickly, the effect of such a cavity can be expected to worsen with use. Thus, such noisemakers have not become commercially viable products.

The object of the present invention therefor, is to provide a footwear noisemaker with selective muting and in a form which does not otherwise interfere with shoe performance.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figure 1:
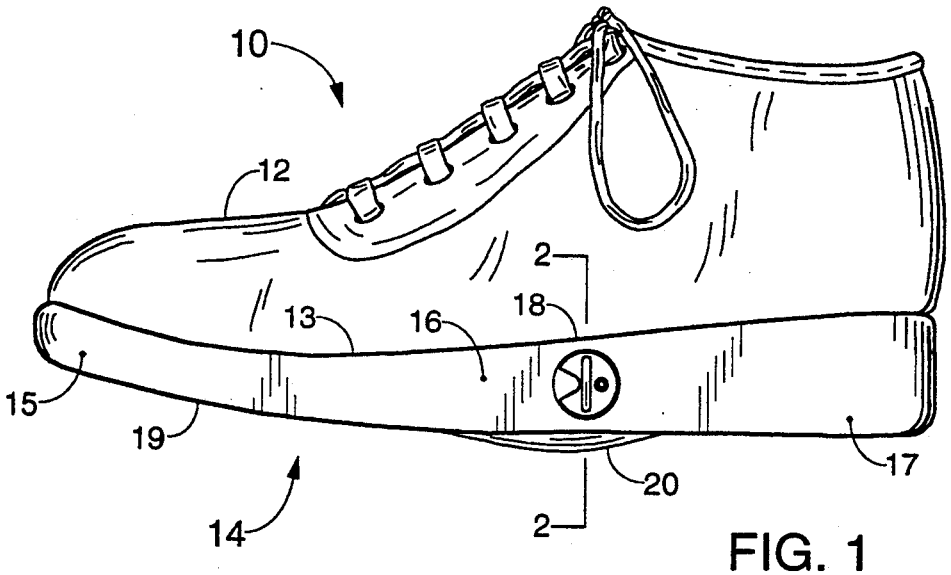
FIG. 1 shows a preferred embodiment of the present invention as incorporated in a typical shoe.
Figure 2:
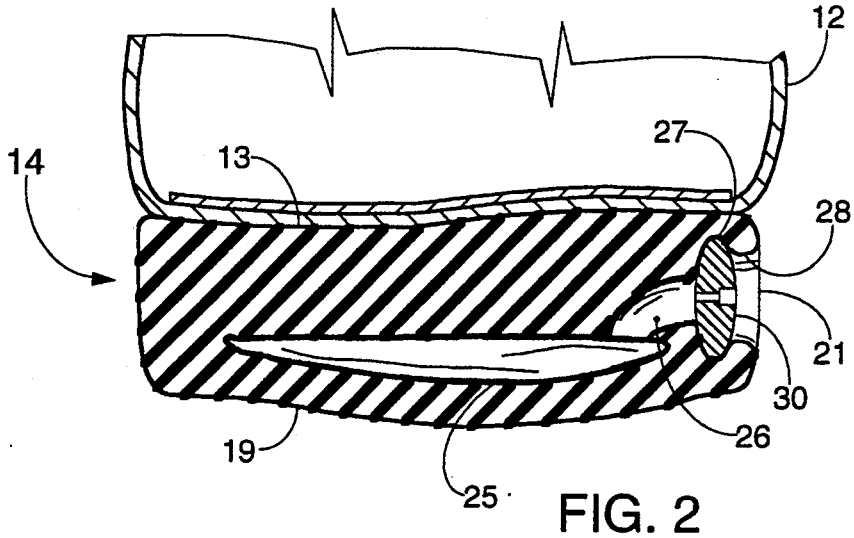
FIG. 2 shows an enlarged section view taken at 2—2 of FIG. 1.

In FIGS. 1 and 2 we see a shoe 10 of typical construction having a fabric upper 12 and an elastomeric sole 14. Sole 14 comprises a toe portion 15, a heel portion 17, and a middle portion 16, which includes the arch 18. The sole bottom 19 is seen to include an outward bulge 20 when not supporting the wearer and in FIG. 3 it is shown that bulge 20 is the external indication of cavity 25. Cavity 25 is formed in the interior of sole 14, between sole upper surface 13 and sole bottom 19, and is placed in the proximity of arch 18 so as to be in an area of minimal wear. The low wear rate of sole bottom 19 in middle portion 16 relates to locally low horizontal shear loads in normal use. As a result, cavity 25 does not affect the feel or performance of shoe 10 when placed in middle portion 16. Cavity 25 changes in volume as the elastomeric sole 14 deforms under load and this causes air to flow in and out through connecting passage 26 to side surface 21 of sole 14. Thus, air flows through squeaker insert 30, held in circular retaining groove 27 by lip 28, and makes a characteristic whistling or squeaking noise as the wearer moves. It is to be noted that the total material thickness above and below cavity 25 is such that when cavity 25 is collapsed there is no local irregularity in the thickness of sole 14.

Figure 3:
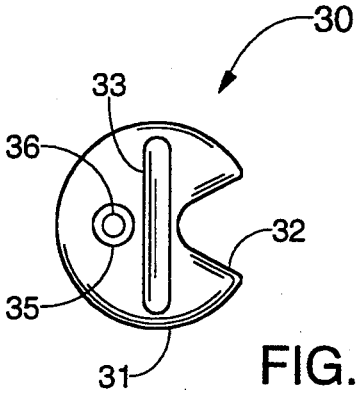
FIG. 3 shows the squeaker insert of FIG. 1.

FIG. 3 shows squeaker insert 30 in greater detail. The circular periphery 31 is interrupted by relief 32 at one side of key slot 33 and whistle 36 is pressed into aperture 35 at the other side.

Figure 4:
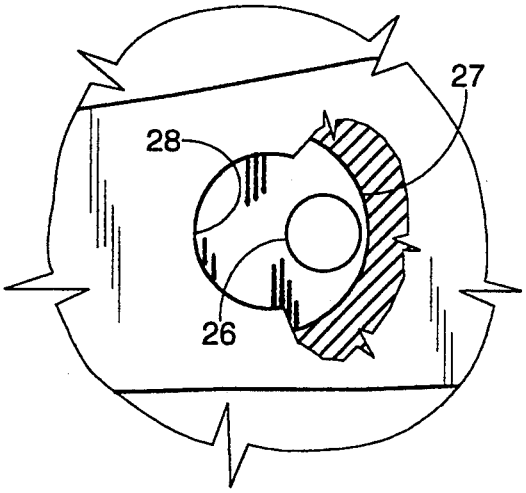
FIG. 4 shows an enlarged view of the area 4 of FIG. 1 with the squeaker insert removed.
Figure 5:
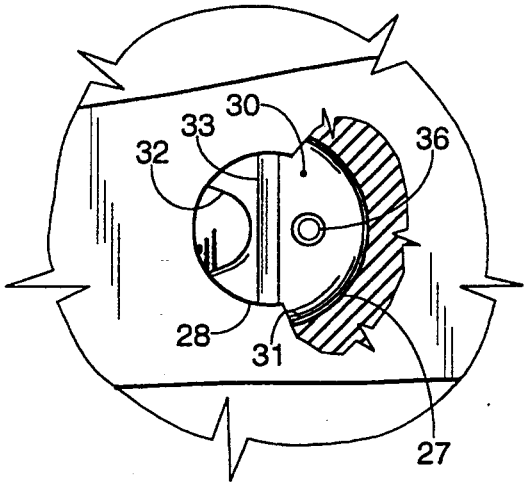
FIG. 5 shows an enlarged view of the area 4 of FIG. 1 with the squeaker insert in the operative position.
Figure 6:
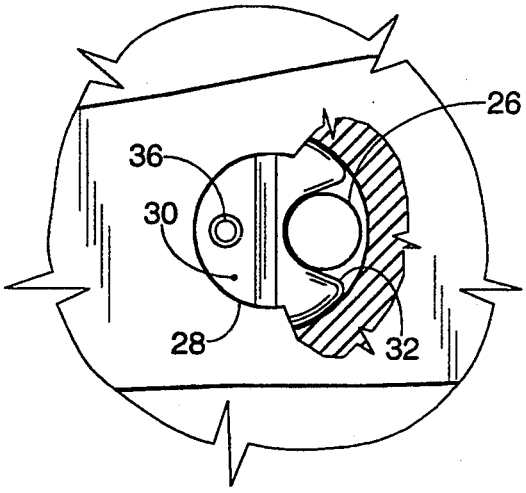
FIG. 6 shows an enlarged view of the area 4 of FIG. 1 with the squeaker insert in the inoperative position.

FIG. 4 shows retaining groove 27 without squeaker insert 30 in place. Here, connecting passage 26 is seen to be located off-center with respect to circular retaining groove 27 and lip 28 is shown to be uniform and concentric thereto. Squeaker insert 30 is next shown installed in FIG. 5, oriented so that whistle 36 is aligned with connecting passage 26, to be activated by air flow as discussed above and relief 32 is blanked off. Friction with lip 28 holds squeaker insert 30 so as not to turn but a coin or similar object can be engaged in key slot 33 to rotate circular periphery 31 of squeaker insert 30 within circular retaining groove 27. In FIG. 6, squeaker insert 30 has been so rotated, placing relief 32 over connecting passage 26 and blanking off whistle 36. In this position all air flow passes freely through relief 32 and squeaker 30 i s rendered inoperative so that no whistling or squeaking noise is made.

It is to be understood that the present invention is not limited to the disclosed embodiments and may be expressed by rearrangement or modification or substitution of parts within the same spirit.

I claim:

1. A noisemaker for a shoe consisting of:

a deformable sole having a heel portion, a toe portion and a middle portion, all with bottom and upper surfaces and an adjoining side surface;

a cavity disposed between said bottom and upper surfaces so as to provide a volume which changes with deformation of said sole;

a passageway in said sole connecting said cavity with said side surface for allowing the flow of air displaced by volume changes of said cavity;

a retaining groove in said deformable sole, around said passageway and located proximate to and substantially parallel to said side surface; and an insert shaped for retention by, and selective positioning within, said groove, said insert including an orifice and means for generating noise by the passage of air therethrough when said insert is in a first selected position and an alternate opening for the passage of air without generating said noise when said insert is in a second selected position.

2. A noisemaker according to claim 1 wherein said noise generating means comprises an air whistle.

3. A noisemaker according to claim 1 wherein said cavity is located in said middle portion.

4. A noisemaker according to claim 1 wherein said retaining groove includes a lip predisposed to hold said insert in a selected position by frictional forces thereon.

5. A noisemaker according to claim 1 wherein said insert includes a transverse key slot to be engaged for selective positioning of said insert within said retaining groove.

6. A noisemaker according to claim 1 wherein said insert is moved from said first position to said second position by rotation within said retaining groove.

* * * * *